US006408488B1

(12) United States Patent
Leder et al.

(10) Patent No.: US 6,408,488 B1
(45) Date of Patent: Jun. 25, 2002

(54) DEVICE FOR SETTING THE CLEARANCE BETWEEN COOPERATING CLOTHINGS IN A FIBER PROCESSING MACHINE

(75) Inventors: Armin Leder, Mönchengladbach; Jürgen März, Düsseldorf, both of (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/983,607

(22) Filed: Oct. 25, 2001

(30) Foreign Application Priority Data

Oct. 26, 2000 (DE) ..... 100 53 139

(51) Int. Cl.[7] ..... D01G 15/84

(52) U.S. Cl. ..... 19/114; 19/98; 19/103; 19/104; 19/113

(58) Field of Search ..... 19/98, 99, 103, 19/104, 105, 108, 110, 112, 113, 114; 57/408; 324/207.11, 207.12, 207.13, 207.15, 207.26; 364/470.01, 470.13, 470.14

(56) References Cited

U.S. PATENT DOCUMENTS 5,040,272 A * 8/1991 Fritzsche ..... 19/104
5,398,381 A * 3/1995 Schlichter et al. ..... 19/102
5,918,349 A * 7/1999 Leifeld et al. ..... 19/103
5,930,869 A * 8/1999 Faas et al. ..... 19/104

FOREIGN PATENT DOCUMENTS

| | | |
|---|---|---|
| DE | 29 48 825 | 8/1989 |
| DE | 39 13 996 | 8/1990 |
| EP | 0 787 841 | 8/1997 |

OTHER PUBLICATIONS

Artzt, et al., "Erfassung dynamischer und thermischer Einflüsse auf den Deckelabstand an der Karde", Melliand Textilberichte, 1–2/1999, pp. 23–25.

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A fiber processing machine includes a roll having a circumferential surface provided with a first clothing having clothing points; a counter member having a surface provided with a second clothing cooperating with the first clothing and having clothing points; and a device for setting a clearance between the clothing points of the first and second clothings. The device includes an arrangement for approaching the roll and the counter member to one another until the clothing points of the first and second clothings contact and for moving away the roll and the counter member from one another until the clothing points of the first and second clothings assume a desired clearance. The device further has an arrangement for emitting a signal when the clothing points of the first and second clothings contact one another.

10 Claims, 6 Drawing Sheets

DEVICE FOR SETTING THE CLEARANCE BETWEEN COOPERATING CLOTHINGS IN A FIBER PROCESSING MACHINE

CROSS REFERENCE TO RELATED APPLICATION

This application claims the priority of German Application No. 100 53 139.3 filed Oct. 26, 2000, which is incorporated herein by reference.

BACKGROUND OF THE INVENTION

This invention relates to a device in a fiber processing machine, such as a carding machine or a cleaner for setting the distance between cooperating clothings, such as the clothing of the main carding cylinder of a carding machine and the clothing of a flat bar of a traveling flats assembly.

The distance between the clothing of the main carding cylinder and the clothing of a member cooperating therewith is of substantial significance as far as machine technology and fiber technology are concerned. The carding result, that is, the cleaning, nep-formation and fiber shortening is to a large measure dependent from the carding clearance, that is, the distance between the clothing of the main carding cylinder and the clothing of the traveling or stationary flat bars. The guidance of air about the main carding cylinder and the heat removal are also dependent from the distance between the clothing of the main carding cylinder and the facing clothed or even non-clothed surfaces, such as a waste separating mote knife or cover elements of the machine. The extent of the distances depend from different, partially opposed effects. The wear of cooperating clothings leads to an enlargement of the carding clearance which results in an increase of the nep number and a decrease of the fiber shortening. An increase in the carding cylinder rpm, for example to increase the cleaning effect, causes, because of centrifugal forces, an enlargement of the carding cylinder, including its clothing and thus a decrease in the carding clearance results. The carding cylinder also expands and thus the carding clearance decreases because of the temperature increase in case a large quantity of fiber is processed or particular fiber types, for example, chemical fibers are handled.

In practice, during assembly of a carding machine, first the flat bars are installed and then the distance between the clothing points of the carding cylinder clothing and the clothing points of the flat bar clothings is determined by gauges. Such a distance is measured, for example, at every other flat bar, and an average value is formed from the measured values. The flat bars of a flat bar set regularly have different heights so that the distances are accordingly different. For changing the distance between the points of the flat bar clothings and the points of the main carding cylinder clothing, that is, to set a predetermined carding clearance, the position of the flexible bend (carrying the sliding guide for the flat bars) is radially adjusted at several locations by means of set screws. Thus, by changing the position of the sliding guide, the radial position of the flat bars is altered and, as a result, the distance between the clothings of the flat bars and the main carding cylinder is set.

An adjustment of the flexible bends as outlined above is complicated, time-consuming and requires skill and experience. Further, the geometry of the flexible bend depends from the number of the circumferentially distributed set screws. It is a further drawback that the entire flexible bend cannot be adjusted in one step. It is a particular disadvantage that the differences in the height positions of the flat bars are included in the measurements. Because of these height differences and the use of a plurality of circumferentially distributed set screws, the carding clearance cannot be set in a desired manner.

In a known arrangement, as described, for example, in European Patent No. 801 158 a sensor is provided with which the working distance of the carding clothings (also termed as "carding clearance") can be measured, that is, the effective distance of the points of a clothing from a machine component facing the clothing can be determined. Such a machine component may also have a clothing but may also be, for example, a cover element provided with a guiding surface. The sensor is configured particularly for measuring the working distance between the carding cylinder and the flat bars of a traveling flats assembly. Such a working distance changes as the wear increases. By means of an optical instrument the carding clearance between the carding cylinder clothing and the flat bar clothings is to be sensed from the side of the working region. It is a disadvantage of this arrangement that the change of the carding clearance gives no indication to what extent the change is to be traced back to the different flat bars.

SUMMARY OF THE INVENTION

It is an object of the invention to provide an improved device of the above-outlined type from which the discussed disadvantages are eliminated and which, in particular, sets the carding clearance in a simple and time-saving manner.

This object and others to become apparent as the specification progresses, are accomplished by the invention, according to which, briefly stated, the fiber processing machine includes a roll having a circumferential surface provided with a first clothing having clothing points; a counter member having a surface provided with a second clothing cooperating with the first clothing and having clothing points; and a device for setting a clearance between the clothing points of the first and second clothings. The device includes an arrangement for approaching the roll and the counter member to one another until the clothing points of the first and second clothings contact and for moving away the roll and the counter member from one another until the clothing points of the first and second clothings assume a desired clearance. The device further has an arrangement for emitting a signal when the clothing points of the first and second clothings contact one another.

The measures according to the invention provide for a very accurate setting of the carding clearance in a simple and time-saving manner. It is a particular advantage of the invention that the setting is carried out without changing the shape of the flexible bend and the sliding guide; as a result, the previously uniformly and precisely set flexible bend and sliding guide retain their shape. It is a further advantage that the setting of a particularly narrow carding clearance is possible. This is of significance since the smaller the carding clearance, the better the carding effect.

DESCRIPTION OF THE PREFERRED EMBODIMENTS

Figure 1:
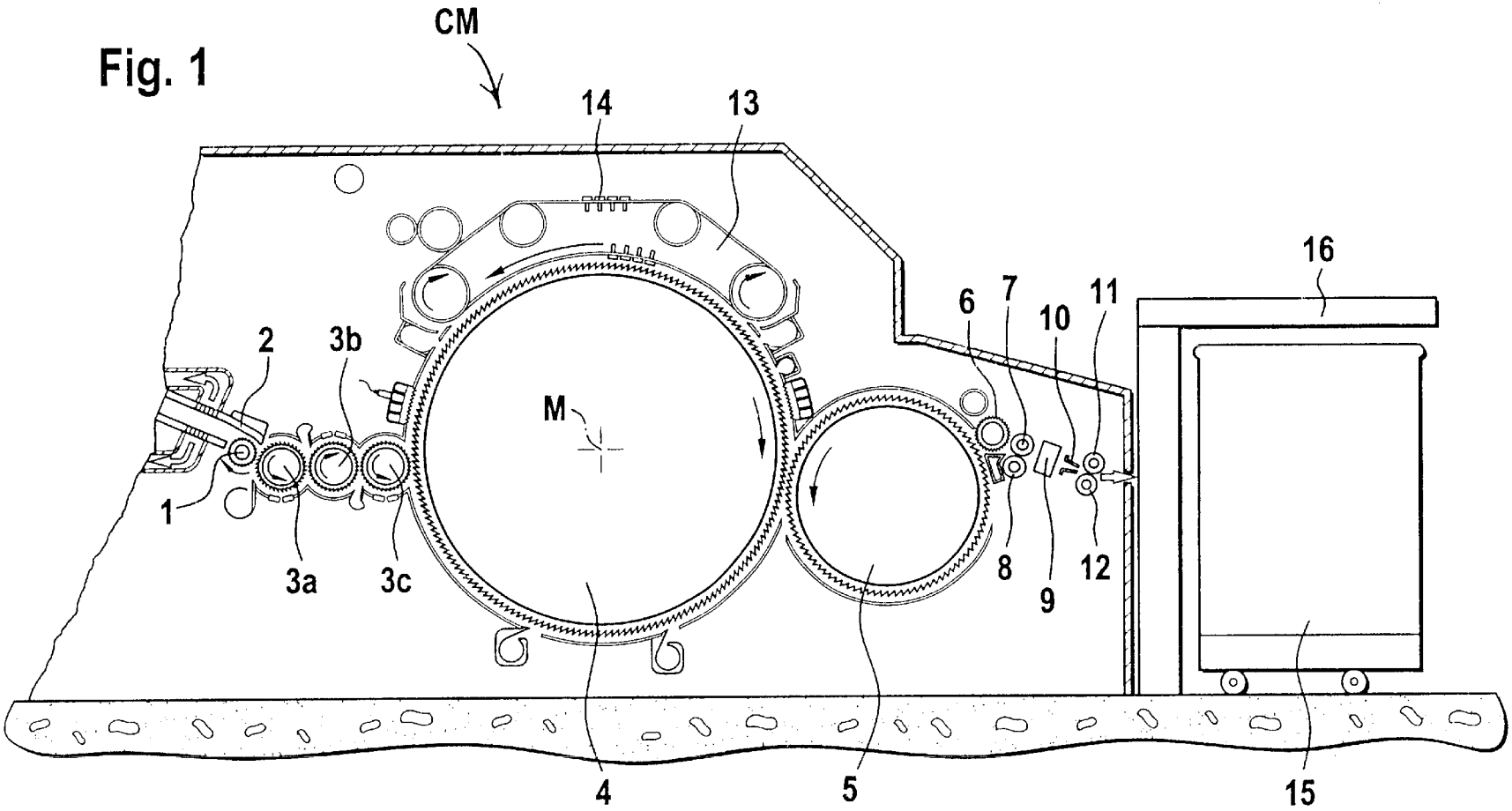
FIG. 1 is a schematic side elevational view of a carding machine incorporating the invention.

FIG. 1 illustrates a carding machine CM which may be for example, an EXACTACARD DK 803 model, manufactured by Trützschler GmbH & Co. KG, Mönchengladbach, Germany. The carding machine CM has a feed roller 1, a feed table 2 cooperating therewith, licker-ins 3*a*, 3*b*, 3*c*, a main carding cylinder 4 having a rotary axis M, a doffer 5, a stripping roll 6, crushing rolls 7, 8, a web guiding element 9, a sliver trumpet 10, calender rolls 11, 12, a traveling flats assembly 13, having flats 14, a coiler can 15 and a sliver coiler 16.

Figure 2:
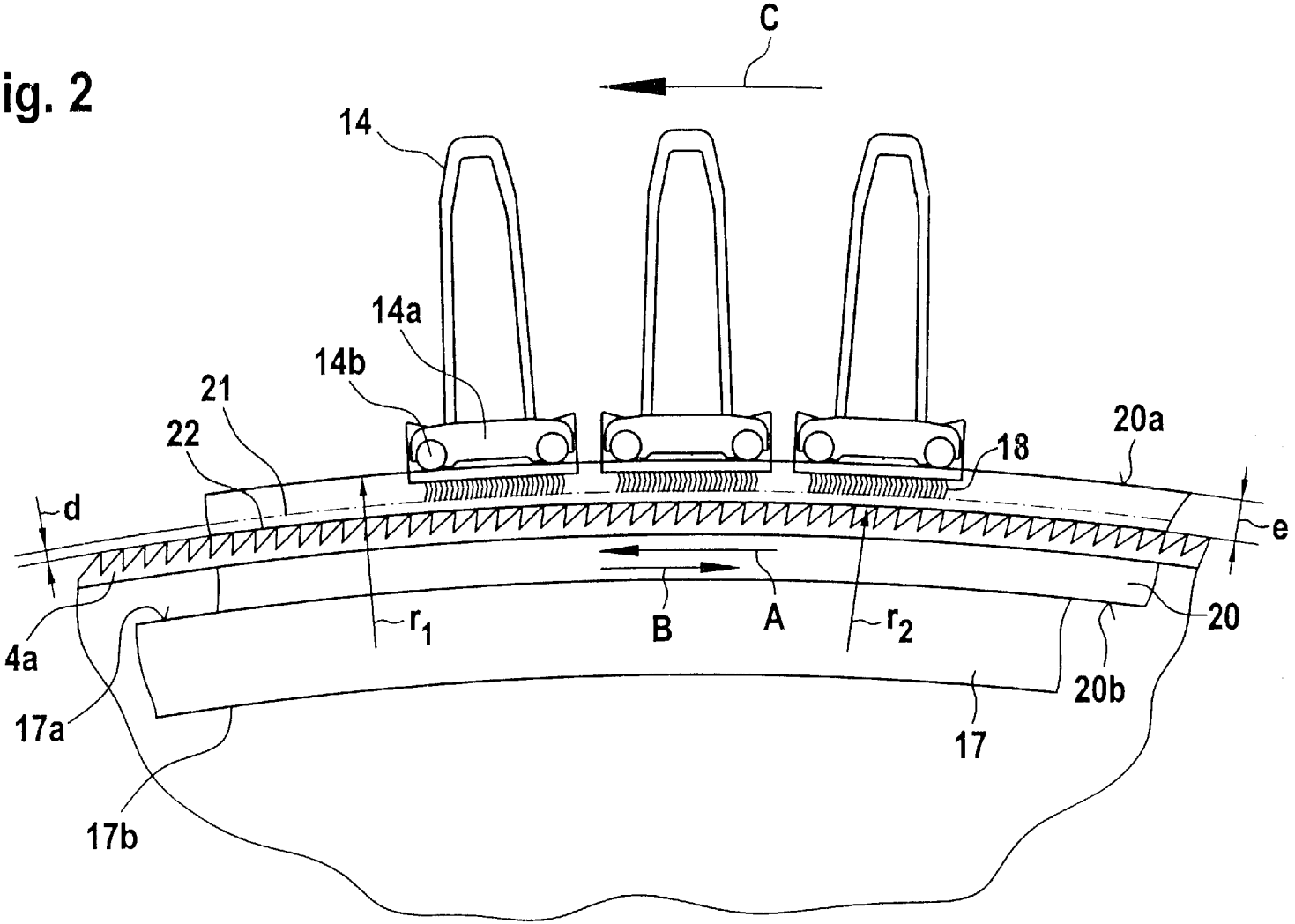
FIG. 2 is a fragmentary side elevational view of a traveling flats assembly.
Figure 5:
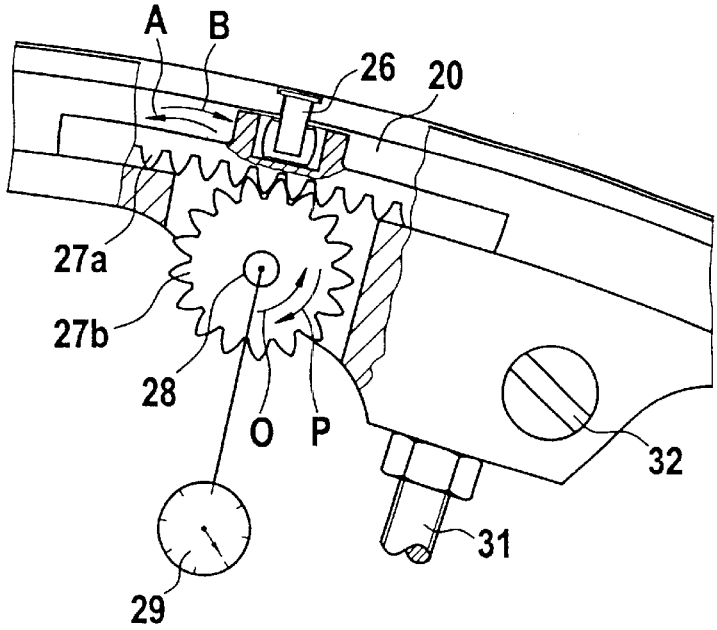
FIG. 5 is a schematic side elevational view of a device for shifting the slide guide.
Figure 7A:
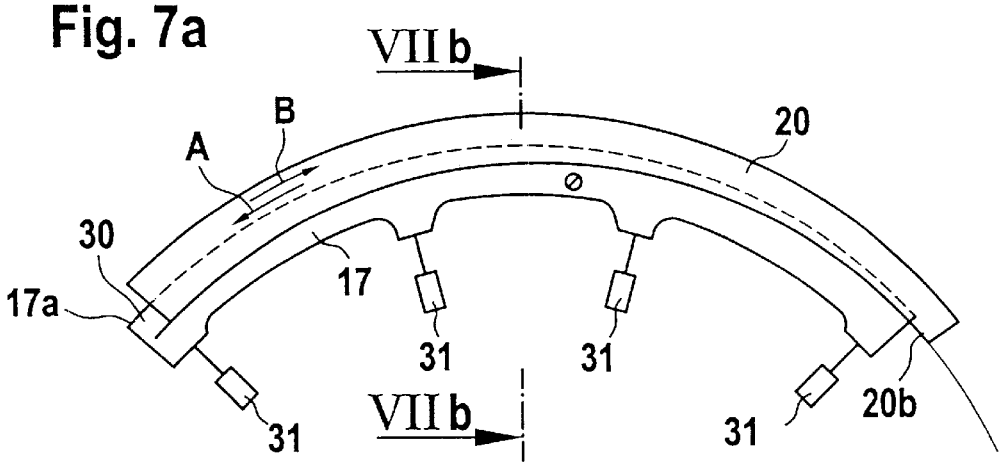
FIG. 7*a* is a schematic side elevational view of a flexible bend having a series of set screws.

Turning to FIGS. 2, 5 and 7*a*, a flexible bend 17 is mounted by screws 32 on either side of the carding machine, laterally of the machine frame. The flexible bend 17 is provided with a plurality of set screws 31. The flexible bend 17 has a convex upper face 17*a* and an underside 17*b*. The upper face 17*a* of the flexible bend 17 supports a slide guide 20, made, for example, of a low-friction synthetic material. The slide guide 20 has a convex upper surface 20*a* and a concave lower surface 20*b*. The concave lower surface 20*b* lies on the convex upper surface 17*a* and may slide thereon as indicated by the arrows A, B. The flat bars 14 have at opposite ends (spaced from one another parallel to the cylinder axis M) a flat bar head 14*a* from which extend two steel pins 14*b* adapted to glide on the convex upper surface 20*a* of the slide guide 20 in the direction of the arrow C. The underface of each flat bar 14 carries a flat bar clothing 18. The circle circumscribed on the flat bar clothings 18 is designated at 21. The carding cylinder 4 has along its circumference a cylinder clothing 4*a* such as a sawtooth clothing. The circle circumscribed about the cylinder clothing 4*a* is designated at 22. The clearance between the circles 21 and 22 is designated at d and amounts to, for example, 0.20 mm. The clearance between the convex upper surface 20*a* of the slide guide 20 and the circle 22 is designated at e. The convex upper surface 20*a* has a radius $r_1$, and the circle 22 has a radius $r_2$. The radii $r_1$ and $r_2$ intersect in the rotary axis M of the carding cylinder 4.

Figure 3A:
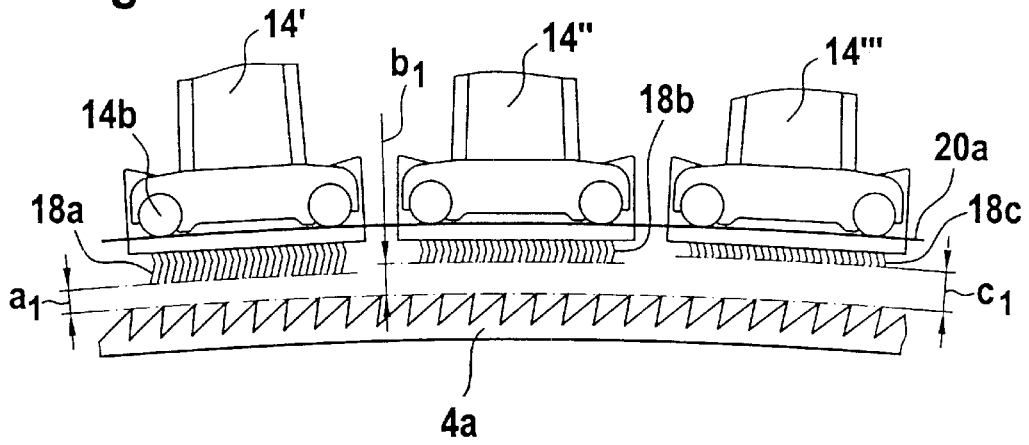
FIGS. 3*a*, 3*b* and 3*c* are fragmentary side elevational views of a traveling flats assembly illustrating the displacement of the flat bars before, during and after contact between the clothing of a flat bar and the clothing of the main carding cylinder.
Figure 3B:
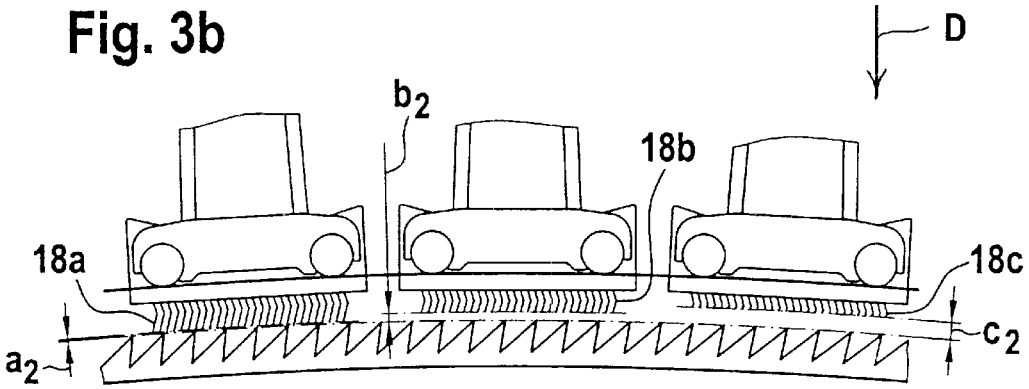
Figure 3C:
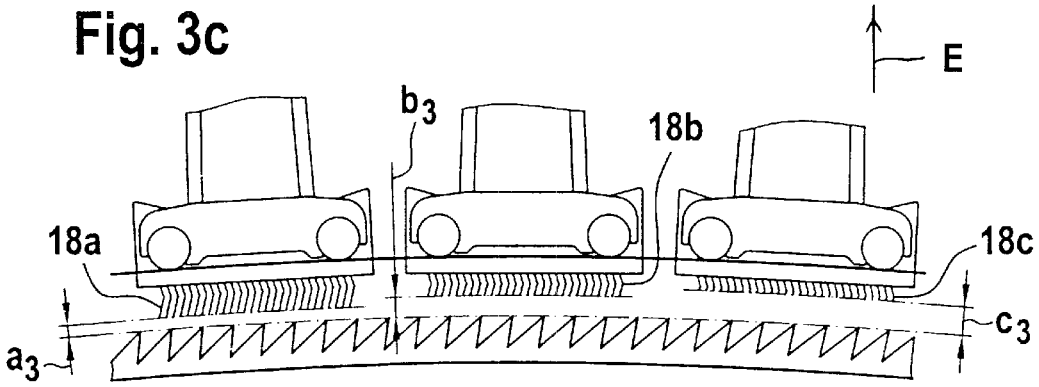

FIGS. 3*a*, 3*b* and 3*c* show, to an exaggerated extent for better understanding, the change of the distances between the clothings 18 of the flat bars 14 and the clothing 4*a* of the carding cylinder 4.

FIG. 3*a* shows the initial position of the flat bars 14', 14", 14'" after their positioning on the upper face 20*a* of the slide guide 20. For manufacturing reasons the respective distances $a_1$, $b_1$, and $c_1$ are different between the respective clothings 18*a*, 18*b* and 18*c*, on the one hand and the cylinder clothing 4*a*, on the other hand. For example, the distance $a_1$, between the clothing 18*a* of the flat bar 14' and the cylinder clothing 4*a* is smaller than the distance $b_1$ (for example, 1/100 inch) between the clothing 18*b* of the flat bar 14" and the cylinder clothing 4*a*, whereas the distance $c_1$ between the clothing 18*c* of the flat bar 14'" and the cylinder clothing 4*a* is greater than the distance $b_1$.

According to FIG. 3*b*, the flat bars 14', 14"and 14'" are slowly shifted radially to the carding cylinder 4 in the direction D until the points of the clothing 18*a* (having the smallest clearance $a_1$, according to FIG. 3*a*) and the cylinder clothing 4*a* are just in contact with one another, that is, the clearance $a_2$ is zero, while the clearance between the clothing 18*b*, 4*a* and between the clothing 18*c*, 4*a* is $b_2$ and $c_2$, respectively. Such a minimal contact is harmless even if the carding cylinder 4 rotates. The contact between a flat bar clothing 18 and the cylinder clothing 4*a* is sensed by a device 23 as will be described in conjunction with FIGS. 6, 6*a*.

Subsequently, as shown in FIG. 3*c*, the flat bars 14', 14" and 14'" are shifted radially in the direction E in such a manner that the points of the clothing 18*a* of the flat bar 14' and the cylinder clothing 4*a* are just separated from one another, that is, a clearance $a_3$ is obtained. The clearance $a_3$ should be as small as safely possible, for example, between 1/1000 and 2/1000 inch. As a result of the above-described manipulation the clearances $b_3$ and $c_3$ are as small as possible. A small distance $a_3$, $b_3$ and $c_3$, that is, a possibly small carding clearance is desirable for achieving superior carding results.

Figure 4A:
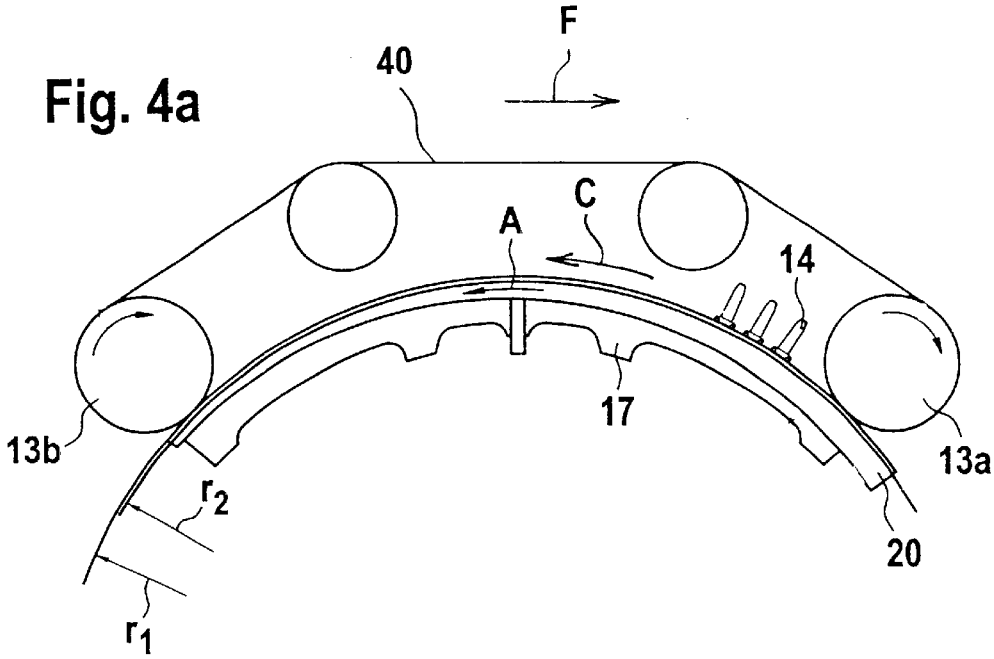
FIG. 4*a* is a schematic side elevational view of a traveling flats assembly, also illustrating the flexible bend and a shiftable slide guide.
Figure 4B:
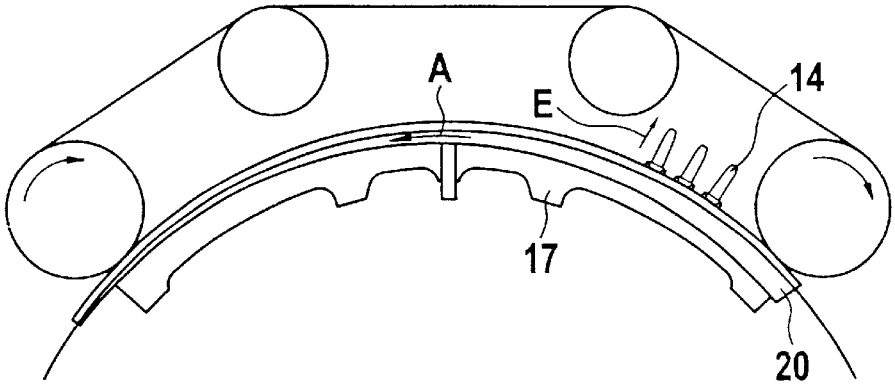
FIG. 4*b* is a view similar to FIG. 4*a* showing the slide guide shifted in the direction A for radially repositioning the flat bars.

In FIGS. 4*a* and 4*b*, shifting of the slide guide 20 on the flexible bend 17 in the direction of the arrow A is shown. Due to the wedge shape of the slide guide 20, its circumferential displacement, for example, in the direction of the arrow A, will increase the clearance $b_1$, $b_2$ and $b_3$ between the respective flat clothings 18*a*, 18*b* and 18*c* on the one hand and the cylinder clothing 4*a*, on the other hand; that is, the clearance between the circles 21 and 22 (FIG. 2) is increased. Thus, by shifting the slide guide 20 in the direction A, the flat bars 14 are lifted from their position shown in FIG. 4*a* in the direction E into the position illustrated in FIG. 4*b*. The flat bars 14 are slowly moved between the end roller 13*a* and the end roller 13*b* of the traveling flats assembly 13 by a belt 40 in the direction C (FIG. 2 and 4*a*) and are reversed as they travel on the end roller 13*b* to be moved on the idling side of the traveling flats assembly in the rearward direction F.

As shown in FIG. 5, a carrier element 26 affixed to the slide guide 20 is coupled with a toothed rack 27*a* engaging a gear 27*b* which is rotatable in the directions O, P and which is rotated by a drive, such as a reversible motor 28. The device can circumferentially shift the slide guide 20 in the direction of the arrow A or B. The drive 28 is coupled with an inputting device 29 with which the desired, smallest carding gap $a_3$, for example, 3/1000 inch may be set as a desired magnitude. Such a setting may also be performed by an electronic control and regulating device 33 (FIG. 8) which has a desired value memory and/or an inputting device.

Figure 6:
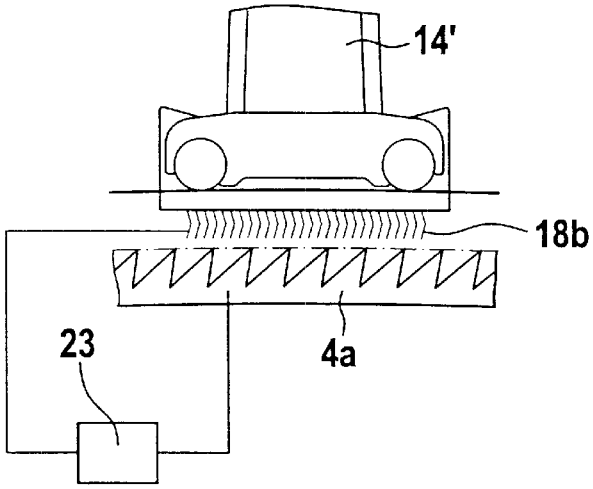
FIGS. 6 and 6*a* are schematic views of an embodiment of a device for determining a contact between clothing points.
Figure 6A:
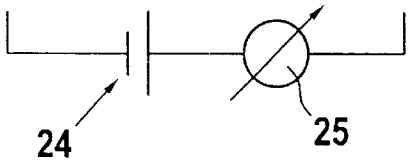

As shown in FIG. 6, a device 23 is coupled to the flat bar clothings 18 and the cylinder clothing 4*a* in an electric circuit for emitting a signal when the clothing 18 of a flat bar 14 contacts the clothing 4*a* of the carding cylinder. Thus, the clothing points of the clothings 4*a* and 18 act as electric contacts. The device 23 may be structured such that the clothing 4*a* of the cylinder 4 whose bearings are electrically insulated from the frame, is connected with one pole of an electric current source 24, whereas the other pole is coupled to the machine frame in a non-illustrated manner, so that the flat bars 14 are coupled with that pole of the current source. The electric circuit contains an indicating device 25 which shows whether or not a contact is present between the clothing points. Such a contacting may also be detected by measuring the electric resistance in the circuit, or by an arrangement based on sound detection. Or, as other alternatives of contact-sensing, the acceleration of the traveling flats is sensed or, in case of a stationary carding cylinder 4, a motion of the carding cylinder as entrained by the contacting traveling flat bar is observed.

Figure 7B:
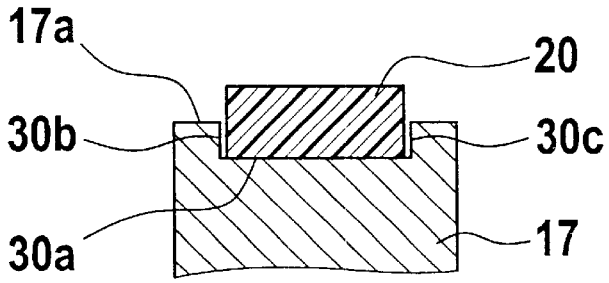
FIG. 7*b* is a sectional view taken along line 7*b*—7*b* of FIG. 7*a*.

Turning to FIG. 7*a*, a circumferential groove 30 is provided in the flexible bend 17. The slide guide 20 which is composed of an elastic, low-friction synthetic material is, as shown in FIG. 7*b*, accommodated in the groove 30 such that one part of the slide guide 20 is situated within the groove 30 whereas another part projects beyond the convex upper surface 17*a* of the flexible bend 17. The slide guide 20 is shiftable within the groove in the direction of the arrows A, B so that the concave lower face 20*b* slides on the bottom surface 30*a* of the groove. The side faces 30*b* and 30*c* of the groove constitute lateral guides for the slide guide 20. By means of the set screws 31 first the flexible bend 17 is set, while maintaining its correct shape, to a carding clearance of, for example, 6/1000 inch. It is only with the device shown in FIGS. 4*a*, 4*b* and 5 that the carding clearance may be reduced to such an extent that the flat bar clothing 18 which originally has the smallest distance from the cylinder clothing 4*a*, contacts the latter. Subsequently, the carding clearance may be set very accurately to a desired magnitude with the device shown in FIGS. 4*a*, 4*b* and 5.

Figure 8:
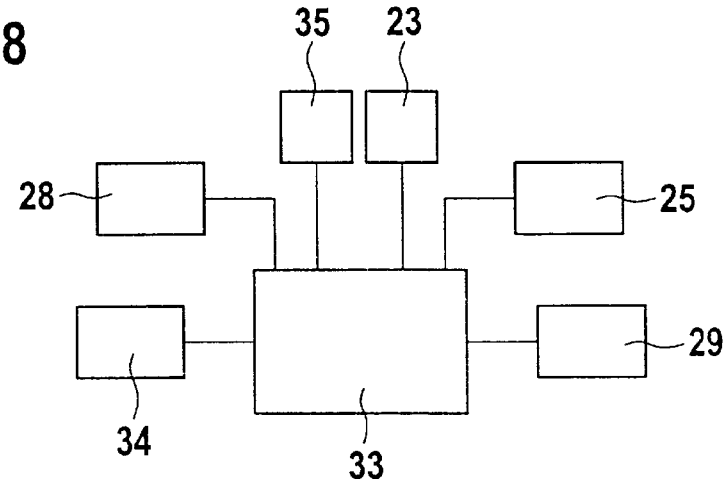
FIG. 8 is a block diagram of an electronic control and regulating device.

FIG. 8 illustrates an electronic control and regulating device 33, such as a microcomputer to which there are connected an inputting device 34 for the desired carding clearance, the drive 28 for rotating the gear 27*b*, the device 23 to detect a contact between the flat bar clothing 18 and the cylinder clothing 4*a*, the indicating device 25, the inputting device 29 and a switching element 35 for actuating the drive 28.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) a roll having a circumferential surface provided with a first clothing having clothing points;

(b) a counter member having a surface provided with a second clothing having clothing points; said first and second clothings cooperating with one another; and (c) a device for setting a clearance between the clothing points of said first and second clothings; said device including (1) means for approaching said roll and said counter member to one another until said clothing points of said first and second clothings contact;

(2) means for moving away said roll and said counter member from one another until said clothing points of said first and second clothings assume a desired clearance; and (3) means for emitting a signal when said clothing points of said first and second clothings contact one another.

2. The fiber processing machine as defined in claim 1, further comprising an electronic control and regulating device; said means for emitting a signal being connected to said electronic control and regulating device.

3. The fiber processing machine as defined in claim 1, further comprising an electronic control and regulating device and an inputting device connected to said electronic control and regulating device for inputting the desired clearance between the clothing points of said first and second clothings.

4. The fiber processing machine as defined in claim 1, wherein said device for setting a clearance includes an indicator for displaying the extent of said clearance.

5. The fiber processing machine as defined in claim 4, further comprising an electronic control and regulating device; wherein said indicator is connected to said electronic control and regulating device.

6. The fiber processing machine as defined in claim 1, wherein said device for setting a clearance includes a drive motor.

7. The fiber processing machine as defined in claim 6, further comprising an electronic control and regulating device; said motor being connected to said electronic control and regulating device.

8. The fiber processing machine as defined in claim 1, wherein said roll is a carding cylinder and said counter member is a flat bar; further wherein said means for emitting a signal comprises an electric circuit and said first and second clothings constitute contact elements of said electric circuit.

9. The fiber processing machine as defined in claim 8, wherein said electric circuit includes an indicator for visually displaying said signal.

10. The fiber processing machine as defined in claim 9, further comprising an electronic control and regulating device; wherein said indicator is connected to said electronic control and regulating device.

* * * * *